US006977573B1

(12) United States Patent
Maeda et al.

(10) Patent No.: US 6,977,573 B1
(45) Date of Patent: Dec. 20, 2005

(54) LAMINATED COIL ARRAY

(75) Inventors: Tomoyuki Maeda, Yasu (JP); Hideaki Matsushima, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/131,487

(22) Filed: May 18, 2005

(30) Foreign Application Priority Data

Jul. 12, 2004 (JP) ..... 2004-205054

(51) Int. Cl.[7] ..... H01F 5/00
(52) U.S. Cl. ..... 336/200
(58) Field of Search ..... 336/65, 83, 192, 336/200, 232; 29/602.1, 604, 609

(56) References Cited

U.S. PATENT DOCUMENTS 5,578,981 A * 11/1996 Tokuda ..... 336/171
6,147,573 A * 11/2000 Kumagai et al. ..... 333/185
6,489,875 B1 * 12/2002 Uchikoba et al. ..... 336/200

FOREIGN PATENT DOCUMENTS

JP 11-162737 * 6/1999
JP 2001-023822 1/2001

* cited by examiner

*Primary Examiner*—Tuyen T Nguyen
(74) *Attorney, Agent, or Firm*—Keating & Bennett, LLP

(57) ABSTRACT

A laminated coil array includes a laminate including a plurality of ceramic layers and a plurality of internal conductors disposed one on top of another, at least three coil conductors defined by electrically connecting internal conductors of the plurality of internal conductors and arranged in line inside the laminate, and external electrodes disposed on a surface of the laminate and electrically connected to end portions of the at least three spiral coil conductors, respectively. In the coil conductors not located on both end portions in the arrangement direction of the coil conductors, the internal conductors are arranged so as to be partially reversed.

19 Claims, 7 Drawing Sheets

LAMINATED COIL ARRAY

BACKGROUND OF THE INVENTION

1. Field of the Invention

The present invention relates to a laminated coil array including a plurality of coil conductors embedded in a ceramic laminate.

2. Description of the Related Art

Among laminated coil arrays used for noise elimination in OA equipment, such as computers, there is a laminated coil array described in Japanese Unexamined Patent Application Publication No. 2001-23822. As shown in FIG. 6, this laminated coil array 91 includes ceramic layers 33, on the surface of which internal conductors 34 to 37 are provided. The internal conductors 34 are electrically connected in series through via holes 43 provided in the ceramic sheets 33 to define a spiral coil conductor L1. In the same manner, the internal conductors 35, 36, and 37 are also electrically connected in series through via holes 43 to define spiral coil conductors L2, L3, and L4.

As shown in FIG. 6, the ceramic layers 33 are laminated in order and, after the ceramic layers 32 including via holes 42 are disposed on their top and bottom surfaces, the layers are integrally fired to form a laminate 45 as shown in FIG. 7. External electrodes 51 to 54 are disposed on the end surfaces of the laminate 45. The external electrodes 51 to 54 are electrically connected to the end portions of the coil conductors L1 to L4 which are led out to the surface of the laminate 45 through via holes 42.

In the laminated coil array 91 having the structure described above, when the coil conductors L1 to L4 are arranged close together in the laminate 45 to reduce the size of the laminated coil array 91, the inductances of the coil conductors L1 to L4 have different values.

That is, in the coil conductors L1 and L4 located at both end portions in the arrangement direction of the coil conductors L1 to L4 in the laminate 45, the magnetic path is narrowed at the end portions of the laminate 45. Therefore, the inductance of the coil conductors L1 and L4 is less than that of the coil conductors L2 and L3 not located at both ends in the arrangement direction of the coil conductors L1 to L4.

SUMMARY OF THE INVENTION

To overcome the problems described above, preferred embodiments of the present invention provide a laminated coil array in which three or more coil conductors are arranged inside a laminate and variations in the inductance of the coil conductors are reduced.

A laminated coil array according to a preferred embodiment of the present invention includes a laminate including a plurality of ceramic layers and a plurality of internal conductors disposed one on top of another, at least three spiral conductors defined by electrically connecting the internal conductors and arranged in line inside the laminate, and external electrodes provided on the surface of the laminate and electrically connected to end portions of the coil conductors. In the laminated coil array, the winding direction of the coil conductors not located at both end portions in the arrangement direction of the coil conductors is partially reversed.

In the laminated coil array according to this preferred embodiment of the present invention, the inductance of coil conductors located at both end portions in the arrangement direction of the coil conductors is substantially equal to the inductance of coil conductors not located at both end portions in the arrangement direction of the coil conductors.

Since the winding direction of the coil conductors not located at both end portions is partially reversed, the inductance of the coil conductors is reduced. That is, in a portion where the winding direction is reversed in the coil conductor, a magnetic field is generated so as to disturb a magnetic field generated by a normally wound portion. The total inductance of the coil conductor is reduced such that the magnetic field generated in the portion where the winding direction is reversed and the magnetic field generated in the normally wound portion cancel each other. As a result, the partially reversed portion of the coil conductors not located at both end portions in the arrangement direction of the coil conductors suppresses variations in the inductances of each coil conductor arranged inside the laminate.

Furthermore, in the laminated coil array according to this preferred embodiment of the present invention, the direct-current resistance of coil conductors located at both end portions in the arrangement direction of the coil conductors is substantially equal to the direct-current resistance of coil conductors not located at both end portions in the arrangement direction of the coil conductors.

More specifically, the direct-current resistance is preferably set to be substantially equal to each other such that the line length of coil conductors located at both end portions in the arrangement direction of the coil conductors is substantially equal to the line length of coil conductors not located at both end portions in the arrangement direction of the coil conductors.

As the line length of the coil conductors increases, the direct-current resistance increases. To suppress variations in the inductance of each coil conductor and to suppress variations in the direct-current resistance, the line length of each of the coil conductors is preferably substantially equal.

However, a method for setting the direct-current resistance to be substantially equal is not limited thereto, and, even if the line lengths are different, the direct-current resistances may be set to be substantially equal by a method for making the line width different.

As described above, according to this preferred embodiment of the present invention, a magnetic field generated by partially reversing the winding direction of the coil conductor cancels a magnetic field generated by a normally wound portion to reduce the total inductance of the coil conductor. Thus, a laminated coil array is obtained in which variations in the inductance of each coil conductor are reduced and the reliability is high. Moreover, for example, when the line length of the coil conductors is set to be substantially equal, a laminated coil array in which variations in the inductance of each coil conductor are reduced and variations in direct-current resistance are also reduced is obtained.

These and other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of the present invention are described with reference to the drawings.

First Preferred Embodiment

Figure 1:
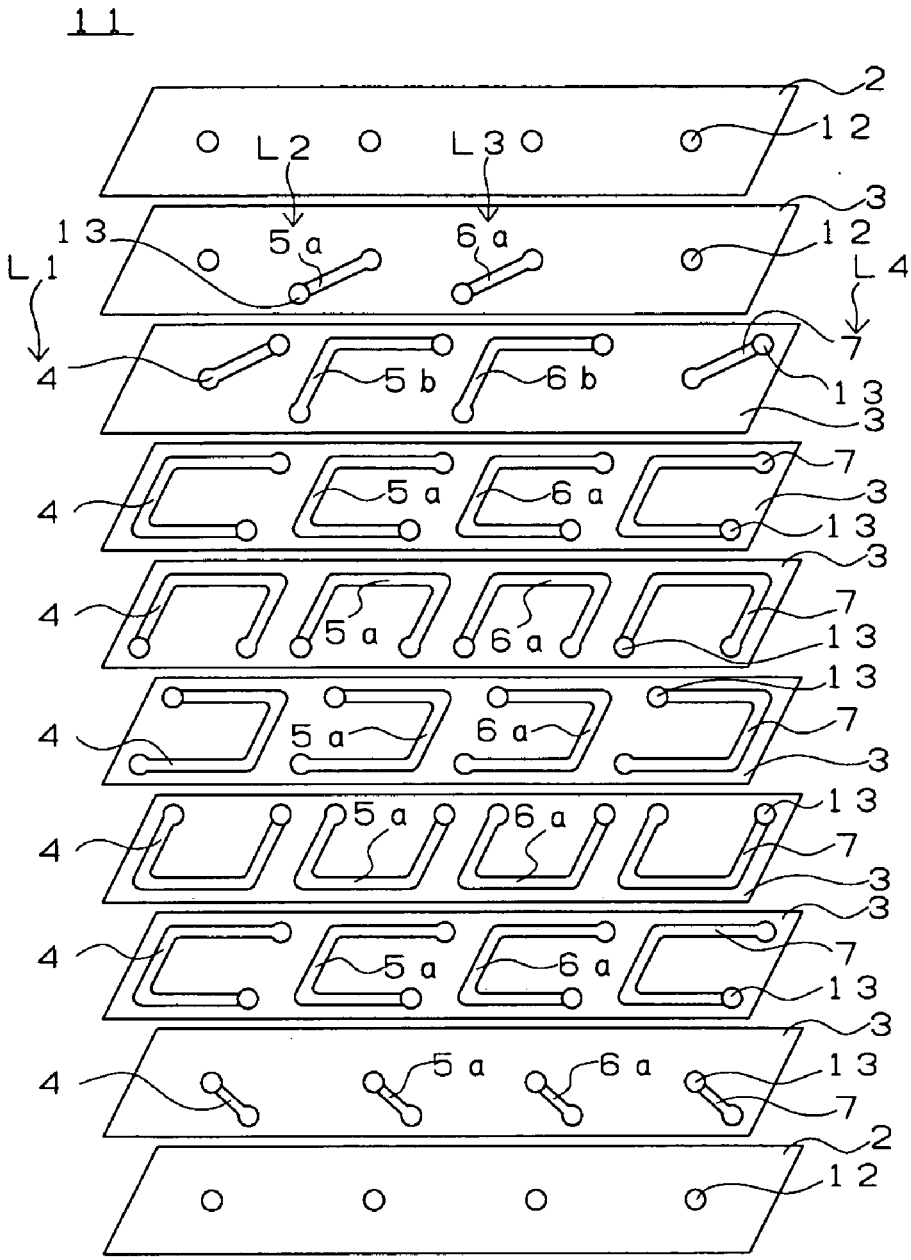
FIG. 1 is an exploded perspective view showing a laminated coil array according to a first preferred embodiment of the present invention.
Figure 2:
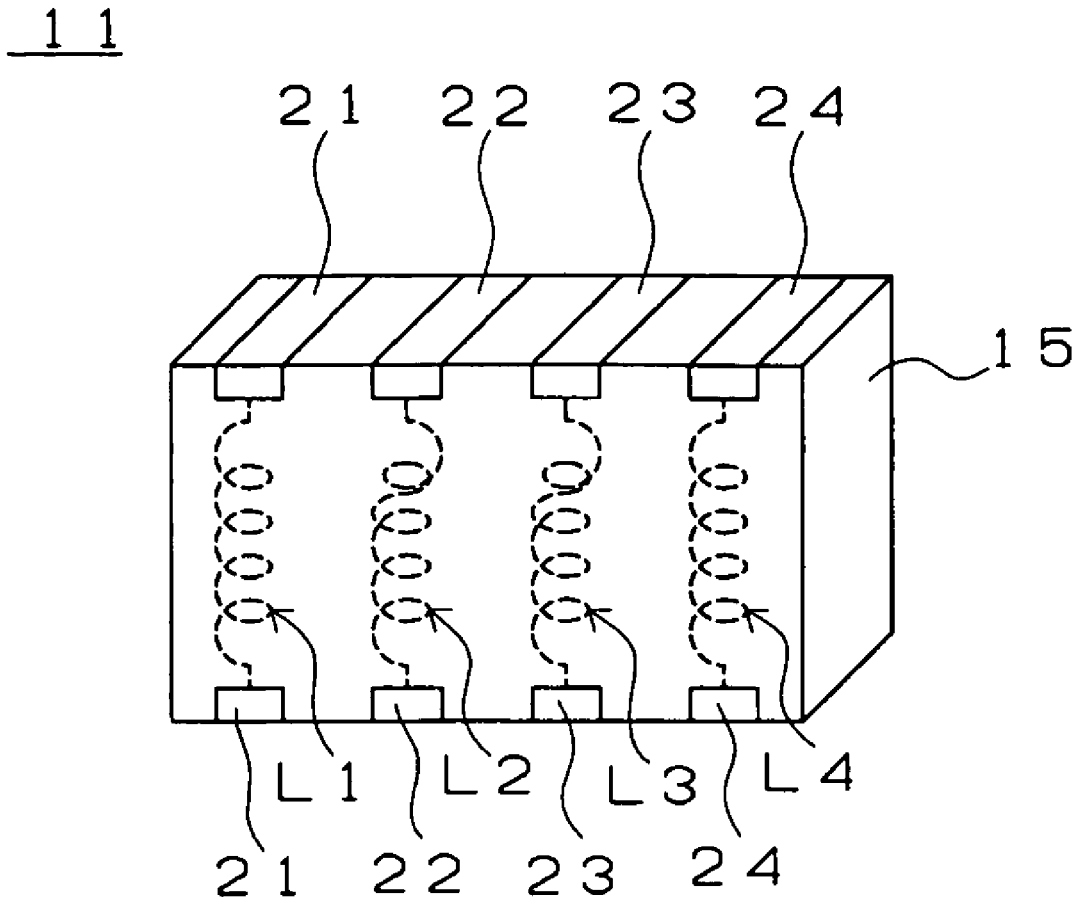
FIG. 2 is a perspective view showing the laminated coil array according to the first preferred embodiment of the present invention.

FIG. 1 is an exploded perspective view showing a laminated coil array 11 according to a first preferred embodiment of the present invention, and FIG. 2 is a perspective illustration of the laminated coil array.

As shown in FIG. 1, the laminated coil array 11 includes ceramic layers 3 having internal conductors 4, 5*a*, 5*b*, 6*a*, 6*b*, and 7 and via holes 12 and 13 disposed at fixed locations and ceramic layers 2 having via holes 12. The internal conductors 4 to 7 are formed on the surface of the ceramic layers 3 by a method of printing, sputtering, evaporation, or other suitable methods. Furthermore, the via holes 12 and 13 are provided by forming through holes and filling the through holes with conductive paste. The internal conductors 4 to 7 and via holes 12 and 13 are made of materials such as Ag, Ag—Pd, Cu, Ni, or other suitable materials. The ceramic layers 2 and 3 are made of magnetic ceramic materials such as an Ni—Cu—Zn system ferrite, or other suitable magnetic ceramic materials.

The internal conductors 4 are electrically connected in series through the via holes 13 in the ceramic layers 3 to define a spiral coil conductor L1. In the same manner, the internal conductors 5*a*, 5*b*, 6*a*, 6*b*, and 7 are also electrically connected in series to define spiral coil conductors L2, L3, and L4.

As shown in FIG. 1, the internal conductors 5*b* and 6*b* defining the coil conductors L2 and L3, which are not located at both end portions in the arrangement direction of the coil inductors L1 to L4, are provided on the surface of the ceramic layers 3 so as to partially reverse the winding direction of the coil conductors L2 and L3. More specifically, when the laminated coil array 11 is seen from the upper portion of the drawing, although the internal conductors 4, 5*a*, 5*b*, and 7 are arranged such that the coil conductors L1 to L4 are wound counterclockwise, the internal conductors 5*b* and 6*b* are arranged so as to be wound clockwise. Thus, the winding direction of the coil conductors L2 and L3 are partially reversed at portions where the internal conductors 5*b* and 6*b* are disposed.

Then, as shown in FIG. 1, the ceramic layers 3 are laminated in order and the ceramic layers 2 having the via holes 12 are disposed on the top and bottom surfaces of the ceramic layers 3. After that, the ceramic layers 2 and 3 are pressed and integrally fired to form a laminate 15 as shown in FIG. 2. Inside the laminate 15, the four coil conductors L1 to L4 are arranged in line in a direction that is substantially perpendicular to the direction of the coil axis. Furthermore, external electrodes 21 to 24 of the coil conductors L1 to L4 are provided on the end surfaces of the laminate 15. The external electrodes 21 to 24 are electrically connected to the coil conductors L1 to L4 that are led out to the surface of the laminate 15 through the via holes 12. These external electrodes 21 to 24 are formed such that, after the conductive paste of Ag, Ag—Pd, Cu, Ni, or other suitable conductive paste, has been printed, it is baked or further wet plated.

In the laminated coil array 11 having the above-described structure, a magnetic field generated in a portion where the winding is reversed from that of the other portions of the coil conductors L2 and L3 cancels a magnetic filed generated in a normally wound portion to reduce the total inductance of the coil conductors L2 and L3. As a result, the variations between the inductance of the coil conductors L1 and L4 located at both end portions in the arrangement direction of the coil conductors L1 and L4 and the inductance of the coil conductors L2 and L3 not located at both end portions in the arrangement direction are reduced.

Second Preferred Embodiment

Figure 3:
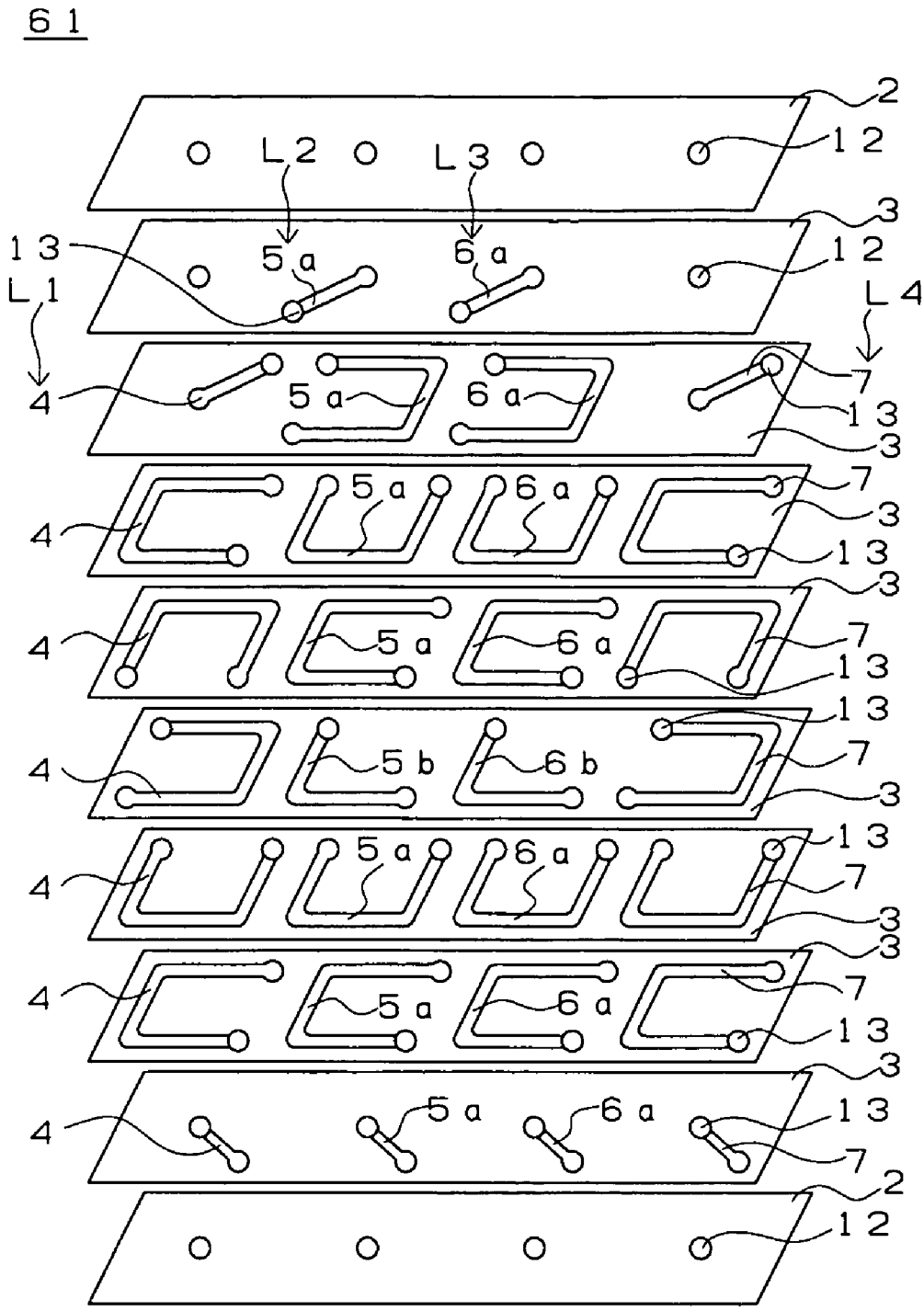
FIG. 3 is an exploded perspective view showing a laminated coil array according to a second preferred embodiment of the present invention.

FIG. 3 is an exploded perspective view showing a laminated coil array 61 according to a second preferred embodiment of the present invention. Moreover, in FIG. 3, the portions in common with or corresponding to those in FIG. 1 are given the same reference numerals, and their description is omitted.

In the laminated coil array 61 according to the present preferred embodiment, as shown in FIG. 3, the internal conductors 5*b* and 6*b* defining the coil conductors L2 and L3 are provided on the surface of the ceramic layers such that the winding direction of the coil conductors L2 and L3 is partially reversed. More specifically, when the laminated coil array 61 is seen from the upper portion of the drawing, although the internal conductors 4, 5*a*, 6*a*, and 7 are arranged such that the coil conductors L1 and L4 are wound counterclockwise, the internal conductors 5*b* and 6*b* are wound clockwise. Thus, the winding direction of the coil conductors L2 and L3 is partially reversed in the middle portion at which the internal conductors 5*b* and 6*b* are provided.

Then, a magnetic field generated in a portion where the winding is reversed from that of the other portion of the coil conductors L2 and L3 cancel a magnetic field generated in a normally wound portion to reduce the total inductance of the coil conductors L2 and L3. Thus, variations of the inductance among the coil conductors L1 to L4 are reduced.

Third Preferred Embodiment

Figure 4:
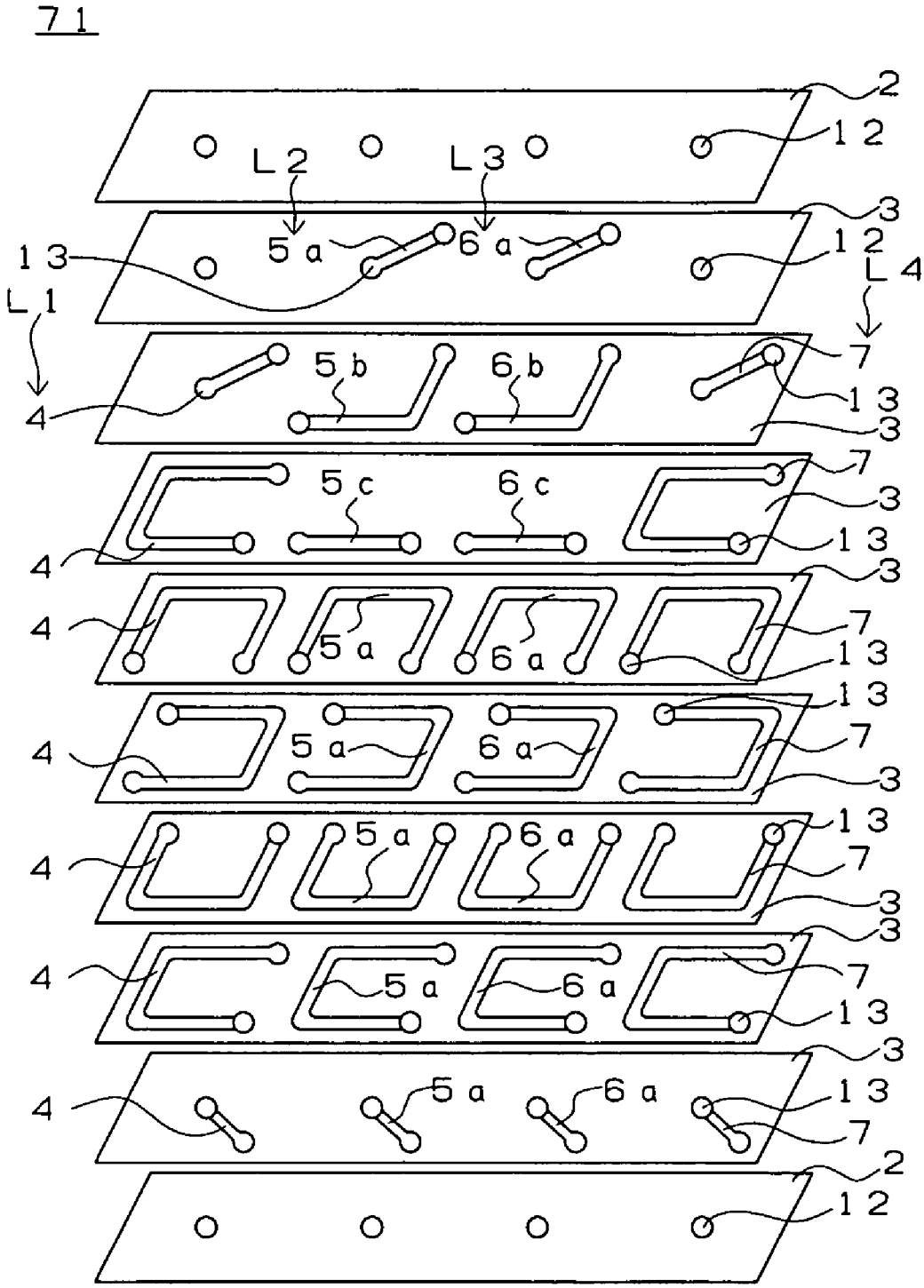
FIG. 4 is an exploded perspective view showing a laminated coil array according to a third preferred embodiment of the present invention.

FIG. 4 is an exploded perspective view showing a laminated coil array 71 according to a third preferred embodiment of the present invention. Moreover, in FIG. 4, the portions in common with or corresponding to those in FIG. 1 are given the same reference numerals, and their description is omitted.

In the laminated coil array 71 according to the present preferred embodiment, as shown in FIG. 4, the internal conductors 5*b* and 6*b* defining the coil conductors L2 and L3 are provided on the surface of the ceramic layers such that the winding direction of the coil conductors L2 and L3 is partially reversed. More specifically, when the laminated coil array 71 is seen from the upper portion of the drawing, although the internal conductors 4, 5*a*, 6*a*, and 7 are formed such that the coil conductors L1 and L4 are wound counterclockwise, the internal conductors 5*b* and 6*b* are wound clockwise. Thus, the winding direction of the coil conductors L2 and L3 is partially reversed.

Furthermore, in the laminated coil array 71 according to the present preferred embodiment, the number of turns of the internal conductors 5*c* and 6*c* is less than that of the internal conductors 4 and 7 provided on the same ceramic layers 3. That is, although the number of turns of the internal conductors 5*c* and 6*c* is approximately ¼, the number of turns of the internal conductors 4 and 7 formed on the same ceramic layer is approximately ¾. The line length of the coil conductors L2 and L3 is increased by forming the internal conductors 5*b* and 6*b*. Then, the line length of the coil conductors L1 to L4 is set to be substantially equal such that the number of turns of the internal conductors 5*c* and 6*c* is less than that of the internal conductors 4 and 7 provided on the same ceramic layer 3.

A magnetic field generated in a portion where the winding is reversed from that of the other portion of the coil conductors L2 and L3 cancels a magnetic field generated in a normally wound portion to reduce the total inductance of the coil conductors L2 and L3. Thus, variations of the inductance among the coil conductors L1 to L4 are reduced. Furthermore, since the line lengths of the coil conductors L1 to L4 are substantially equal, variations of the DC resistance of the coil conductors L1 to L4 are reduced.

Fourth Preferred Embodiment

Figure 5:
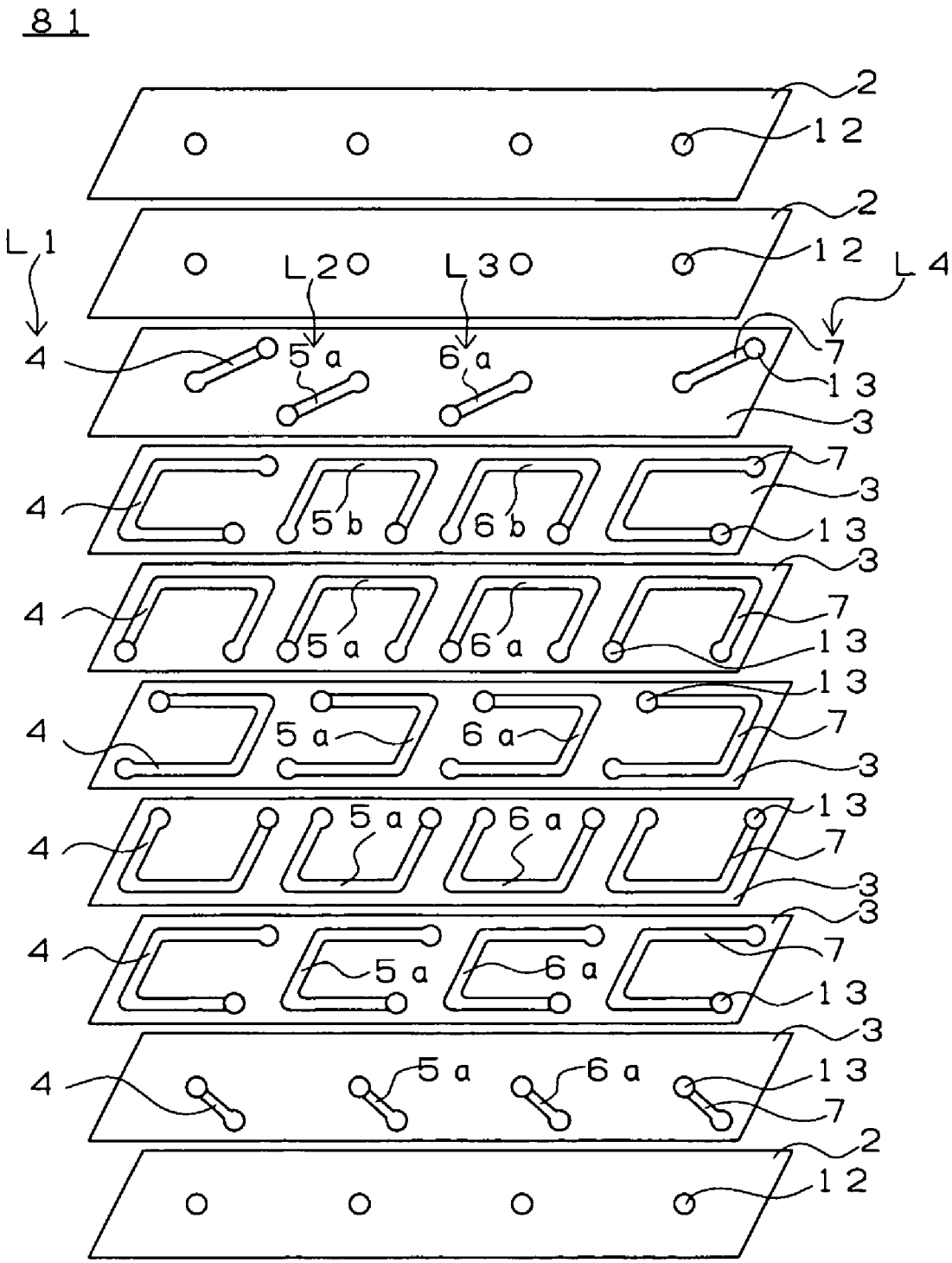
FIG. 5 is an exploded perspective view showing a laminated coil array according to a fourth preferred embodiment of the present invention.
Figure 6:
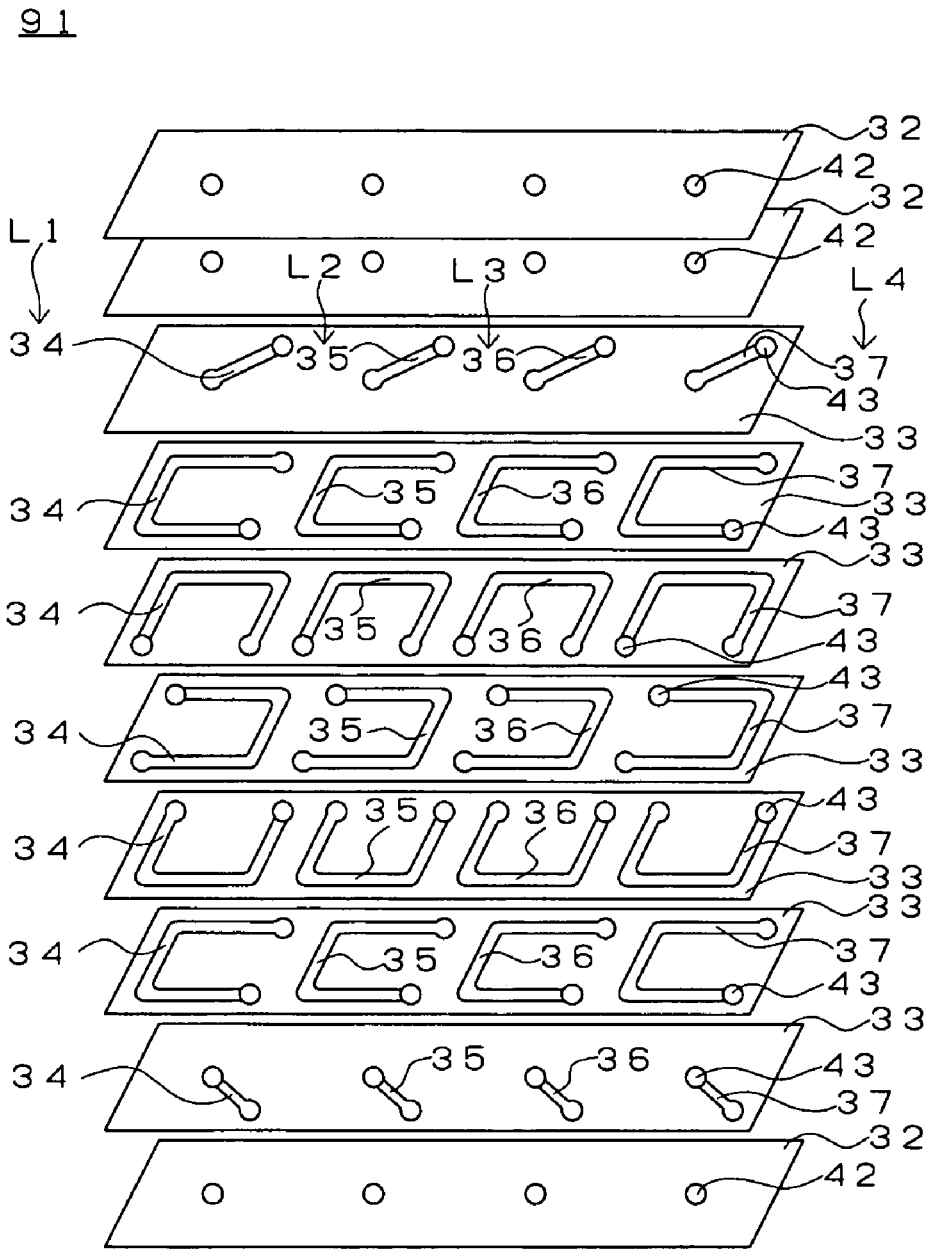
FIG. 6 PRIOR ART
FIG. 6 is an exploded perspective view showing a related laminated coil array.
Figure 7:
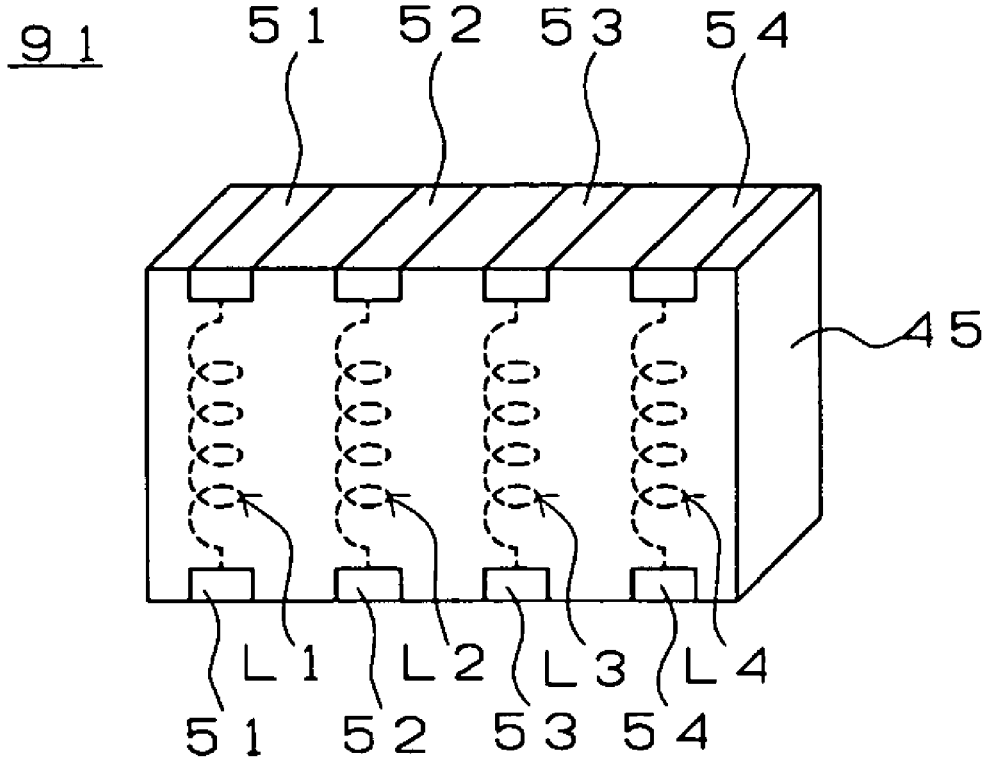
FIG. 7 PRIOR ART
FIG. 7 is a perspective view showing the related laminated coil array.

FIG. 5 is an exploded perspective view showing a laminated coil array 81 according to a fourth preferred embodiment of the present invention. Moreover, in FIG. 5, the portions in common with or corresponding to those in FIG. 1 are given the same reference numerals, and their description is omitted.

In the laminated coil array 81 of the present preferred embodiment, as shown in FIG. 5, the internal conductors 5*b* and 6*b* defining the coil conductors L2 and L3 are provided on the surface of the ceramic layers such that the winding direction of the coil conductors L2 and L3 are partially reversed. More specifically, when the laminated coil array 81 is seen from the upper portion of the drawing, although the internal conductors 4, 5*a*, 6*a*, and 7 are arranged such that the coil conductors L1 and L4 are wound counterclockwise, the internal conductors 5*b* and 6*b* are wound clockwise. Thus, the winding direction of the coil conductors L2 and L3 is partially reversed.

Furthermore, in the laminated coil array 81 of the present preferred embodiment, on the ceramic sheet 3 on which the internal conductors 5*b* and 6*b* defining the coil conductors L2 and L3 are disposed, the internal conductors 4 and 7 defining the coil conductors L1 and L4 are also arranged so as to have substantially the same number of turns. That is, the internal conductors 5*b* and 6*b* and the internal conductors 4 and 7 are provided on the same ceramic sheet such that they have substantially the same number of turns and the coil conductors are wound in opposite directions.

A magnetic field generated in a portion where the winding is reversed from that of the other portion of the coil conductors L2 and L3 cancels a magnetic field generated in a normally wound portion to reduce the total inductance of the coil conductors L2 and L3. Thus, variations of the inductance among the coil conductors L1 to L4 are reduced. Furthermore, since the line length of the coil conductors L1 to L4 is substantially equal, variations of the DC resistance of the coil conductors L1 to L4 are reduced.

Moreover, a laminated coil array according to the present invention is not limited to the above-described preferred embodiments, but it can be variously changed and modified within the scope of the invention. For example, the internal conductor, which arranged such that the winding direction of the coil conductor may be partially reversed, may be continuously or discontinuously arranged over a plurality of ceramic layers. Furthermore, in the above-described preferred embodiments, the surface perpendicular to the direction of the coil axis defines the main surface for forming the external electrodes, however, the surface parallel to the direction of the coil axis may be the main surface for forming the external electrodes. Moreover, in the above-described preferred embodiments, although only the coil conductors are formed inside the laminate, capacitors that are connected in series or in parallel to the coil conductors may be provided. In conclusion, when three or more coil conductors which are electrically separated from each other are arranged inside a laminate, the present invention may be applied.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the invention.

What is claimed is:

1. A laminated coil array comprising:

a laminate including a plurality of ceramic layers and a plurality of internal conductors disposed one on top of another;

at least three coil conductors defined by electrically connecting internal conductors of the plurality of internal conductors and arranged in line inside the laminate; and external electrodes disposed on a surface of the laminate and electrically connected to end portions of the at least three spiral coil conductors, respectively; wherein a winding direction of coil conductors not located at both end portions in an arrangement direction of the at least three coil conductors is partially reversed.

2. A laminated coil array as claimed in claim 1, wherein an inductance of coil conductors located at both end portions in the arrangement direction of the at least three coil conductors is substantially equal to an inductance of the coil conductors not located at both end portions in the arrangement direction of the at least three coil conductors.

3. A laminated coil array as claimed in claim 1, wherein a direct-current resistance of coil conductors located at both end portions in the arrangement direction of the at least three coil conductors is substantially equal to a direct-current resistance of the coil conductors not located at both end portions in the arrangement direction of the at least three coil conductors.

4. A laminated coil array as claimed in claim 3, wherein a line length of the coil conductors located at both end portions in the arrangement direction of the at least three coil conductors is substantially equal to a line length of the coil conductors not located at both end portions in the arrangement direction of the at least three coil conductors.

5. A laminated coil array as claimed in claim 1, wherein the internal conductors are electrically connected by through holes provided in the plurality of ceramic layers.

6. A laminated coil array as claimed in claim 1, wherein each of the plurality of ceramic layers is made of a magnetic ceramic material.

7. A laminated coil array as claimed in claim 6, wherein the magnetic ceramic material is a Ni—Cu—Zn system ferrite.

8. A laminated coil array as claimed in claim 1, wherein the plurality of internal conductors are made of a material selected from the group consisting of Ag, Ag—Pd, Cu and Ni.

9. A laminated coil array as claimed in claim 1, wherein a partially reversed portion of the coil conductors not located at both end portions in an arrangement direction of the at least three coil conductors is located at an approximate center of the laminate in a laminating direction.

10. A laminated coil array comprising:

a laminate having a plurality of ceramic layers and a plurality of internal conductors disposed one on top of another;

at least three coil conductors defined by electrically connecting internal conductors of the plurality of internal conductors and arranged in line inside the laminate; and external electrodes disposed on a surface of the laminate and electrically connected to end portions of the at least three spiral coil conductors, respectively; wherein coil conductors not located at both end portions in an arrangement direction of the at least three coil conductors include portions that are wound in a winding direction and at least one portion that is wound in a direction opposite to the winding direction.

11. A laminated coil array as claimed in claim 10, wherein an inductance of coil conductors located at both end portions in the arrangement direction of the at least three coil conductors is substantially equal to an inductance of the coil conductors not located at both end portions in the arrangement direction of the at least three coil conductors.

12. A laminated coil array as claimed in claim 10, wherein a direct-current resistance of coil conductors located at both end portions in the arrangement direction of the at least three coil conductors is substantially equal to a direct-current resistance of the coil conductors not located at both end portions in the arrangement direction of the at least three coil conductors.

13. A laminated coil array as claimed in claim 12, wherein a line length of the coil conductors located at both end portions in the arrangement direction of the at least three coil conductors is substantially equal to a line length of the coil conductors not located at both end portions in the arrangement direction of the at least three coil conductors.

14. A laminated coil array as claimed in claim 10, wherein the internal conductors are electrically connected by through holes provided in the plurality of ceramic layers.

15. A laminated coil array as claimed in claim 10, wherein each of the plurality of ceramic layers is made of a magnetic ceramic material.

16. A laminated coil array as claimed in claim 15, wherein the magnetic ceramic material is a Ni—Cu—Zn system ferrite.

17. A laminated coil array as claimed in claim 10, wherein the plurality of internal conductors are made of a material selected from the group consisting of Ag, Ag—Pd, Cu and Ni.

18. A laminated coil array as claimed in claim 10, wherein the at least one portion that is wound in a direction opposite to the winding direction is located at an approximate center of the laminate in a laminating direction.

19. A laminated coil array as claimed in claim 10, wherein the at least one portion that is wound in a direction opposite to the winding direction is located at an upper portion of the laminate in a laminating direction.

* * * * *